US009394678B1

(12) United States Patent
Macyko

(10) Patent No.: US 9,394,678 B1
(45) Date of Patent: Jul. 19, 2016

(54) FLOOR DRAIN SEALING VALVE

(71) Applicant: Robert Macyko, Erie, PA (US)

(72) Inventor: Robert Macyko, Erie, PA (US)

( * ) Notice: Subject to any disclaimer, the term of this patent is extended or adjusted under 35 U.S.C. 154(b) by 0 days.

(21) Appl. No.: 14/683,688

(22) Filed: Apr. 10, 2015

(51) Int. Cl.
*F16L 5/02* (2006.01)
*E03F 7/04* (2006.01)
*E03C 1/298* (2006.01)

(52) U.S. Cl.
CPC .. *E03F 7/04* (2013.01); *E03C 1/298* (2013.01)

(58) Field of Classification Search
CPC ... E03F 7/04; E03F 5/0411; E03F 2005/0417; E03F 5/04; E03C 1/298; E03C 1/23; E03C 1/286
USPC ..... 251/216, 359, 339; 137/362, 264
See application file for complete search history.

(56) References Cited

U.S. PATENT DOCUMENTS 565,320 A * 8/1896 Barratt ..... F16K 37/0008 137/362
645,749 A * 3/1900 Kasschau ..... E03C 1/23 210/163

* cited by examiner

*Primary Examiner* — Kevin Lee
*Assistant Examiner* — P. Macade Nichols
(74) *Attorney, Agent, or Firm* — Richard K Thomson

(57) ABSTRACT

A sealing valve for a floor drain has three principal components held together by an actuating bolt. When tightened, the operating bolt compresses a central elastomeric member between a base portion of a first flanged member and a flat compression plate sealing off peripheral passageways as well as those extending through the flanged member and elastomeric member preventing incursion into the residence by sewage, sewer gases, bugs, rodents and other pests.

3 Claims, 2 Drawing Sheets

FLOOR DRAIN SEALING VALVE

BACKGROUND AND SUMMARY OF THE INVENTION

The present invention is directed to the field of floor drains. More particularly, the present invention is directed to a manually actuated sealing valve for use in floor drains. The floor drain sealing valve of the present invention may be retrofit in by a do-it-yourself home or business owner to minimize overall expense by eliminating labor costs.

When the water in a floor drain dries up, generally 3-4 weeks after the most recent storm, a passageway is opened which gives vent to nauseating odors from sewer gases and provides pests, such as bugs and rodents, access to the basement through the dried/drying drainage lines.

The present invention is comprised of a floor drain sealing valve which can be installed in the drain by a home/business owner. The unit consists of three principle elements secured together by an actuating bolt: a) a flanged first metallic member; b) a second cylindrical elastomeric member; and, c) a third member comprised of a metallic compression plate. Holes in the upper flange of the first member communicate with passageways through and around the elastomeric member. By utilizing an allen wrench, the operating bolt can compress the elastomeric member, expanding it into sealing engagement with the inner periphery of the floor drain. Additionally, the compression plate closes off the passageways through the first and second members. This closes off all passageways through which sewer gases, bugs and other pests might migrate into the home. Should it be necessary to allow water to flow through the valve, the allen wrench can be utilized to rotate the operating bolt opening the flow paths so the water above the valve may drain.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
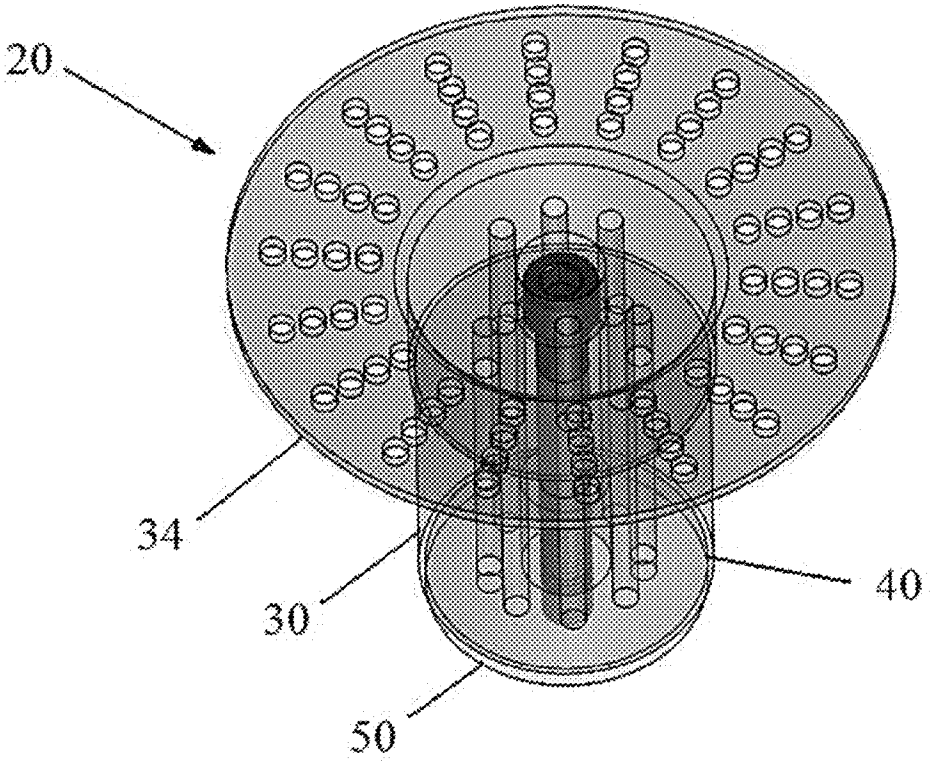
FIG. 1 is a top perspective opaque schematic view of a first embodiment of the floor drain sealing valve of the present invention.
Figure 2A:
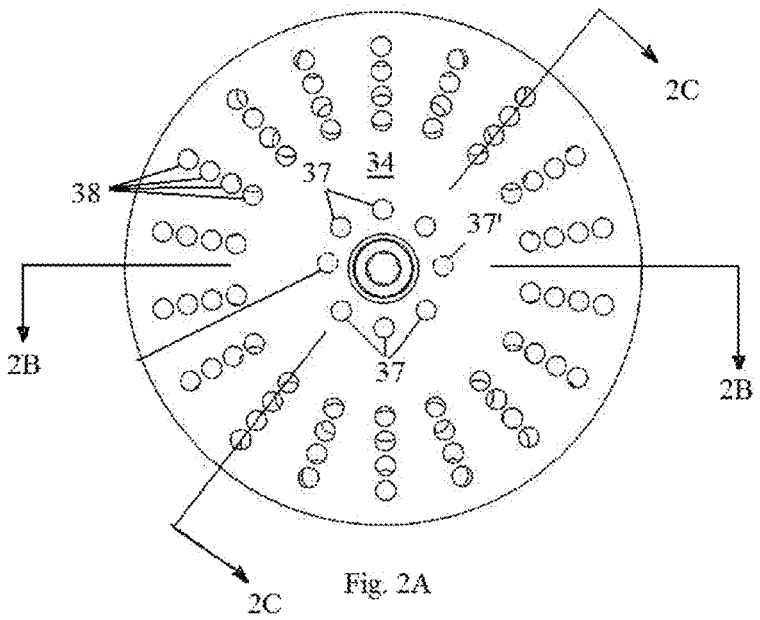
FIG. 2A is a top view of the first embodiment.
Figure 2B:
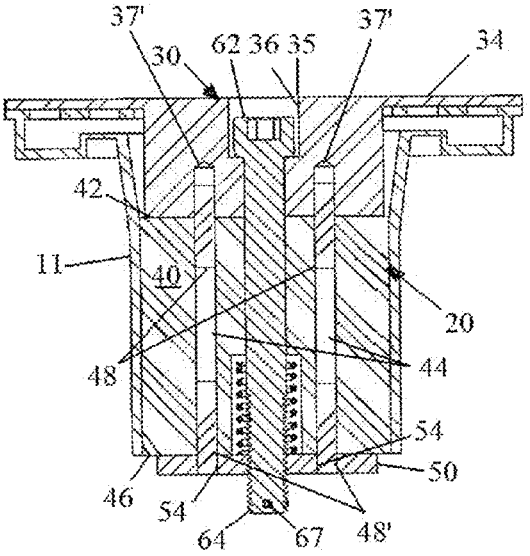
FIG. 2B is a cross-sectional side view as seen along line 2B-2B of FIG. 2A; and, FIG. 2C is a cross-sectional side view as seen along line 2C-2C in FIG. 2A.
Figure 2C:
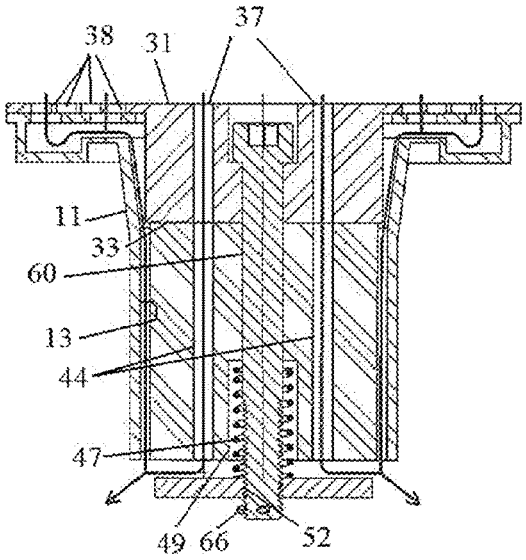

A first embodiment of the floor drain sealing valve of the present invention is depicted in FIGS. 1, 2B and 2C generally at 20. There are three principal components to the floor drain 20 held in assembled position by an actuating bolt 60: a) a first flanged metallic member 30; b) a second cylindrical elastomeric member 40; and, c) a third member comprised as a flat metallic compression plate 50. Each will be described in fuller detail in sequence.

First flanged metallic member 30 is generally toad-stool shaped having a cylindrical base 32 from which the flange 34 protrudes laterally outwardly. Central aperture 35 has a countersunk region 36 which receives the head 62 of actuating bolt 60. First set of holes 37 (FIG. 2C) extend longitudinally through cylindrical base 32 spaced around central aperture 35. Two oppositely directed holes 37' (FIG. 2B) extend from the lower surface 33 of base 32 roughly halfway toward the upper surface 31. A second set of holes 38 are positioned in four circular rows through flange 34, the four rows being concentric with central aperture 35. While metallic member may be made from any metal, it is preferably fabricated from stainless steel of aluminum, due to the corrosive environment into which it is installed.

Second cylindrical elastomeric member 40 has a set of holes 44 extending from top surface 42 to bottom surface 46 at a radius and spacing to align with the first set of holes 37 and the two oppositely positioned holes 37'. The two holes 44 which align with holes 37' receive two position-sustaining dowels 48 which ensure that the drainage holes 37 in base 32 and drainage holes 44 in the second elastomeric member 40 remain in alignment. Coil spring 47 is seated in a recess 49 formed in a lower surface of elastomeric member 40 to ensure that compression plate 50 unseats from bottom surface 46 of the elastomer when the actuating bolt 60 is rotated to the valve-open position. While any elastomeric material might be used, preferably, the second member 40 is made of natural rubber.

Third member, flat compression plate 50, has a central, internally threaded aperture 52 which threadingly receives distal end 64 of actuating bolt 60. In addition, two opposing holes 54 align with a pair of the holes 44 (the same pair as receive position-sustaining dowels 48) in order to receive a second set of position-sustaining dowels 48' to prevent rotation of third member 50 when actuating bolt 60 is tightened or loosened. A cotter pin 66 is inserted through a small aperture 67 adjacent the distal end 64 of actuating bolt 60 to prevent the possibility of compression plate 50 being inadvertently removed from the sealing valve assembly 20 after installation. This member 50 is also preferably manufactured of stainless steel or aluminum.

By way of example and not limitation, the conventional floor drain 11 (FIGS. 2B and 2C) has an internal diameter slightly larger than 3". Accordingly, the base 32 of first metallic member 30 is 3" in diameter with flange 34 extending to 6.5", the elastomeric member has an at-rest diameter of 2.875" and the compression plate 50 2.75". Obviously, floor drain sealing valve 20 can be configured in larger or smaller sizes, as variant floor drains 11 may require.

As best seen in FIG. 2B, when actuating bolt 60 is tightened in threaded aperture 52 of compression plate 50, elastomeric member 40 is compressed expanding laterally outwardly to sealingly engage the interior walls 13 of floor drain 11. In addition, compression plate 50 is snugged up against the bottom of elastomeric member 40 closing off the through apertures 44. Floor drain sealing valve 20 of the present invention has been pressure tested to 80 psi ensuring that should a septic/sewer back up occur, the sealing valve 20 of the present invention will prevent incursion into the homeowner's basement. In addition, in this sealed position, noxious gases, insects, rodents and other pests are, likewise, denied entry.

When water builds up around the drain, the homeowner simply uses an allen wrench to loosen actuating bolt 60 which allows the elastomeric member 40 to retract to its standard diameter opening flow paths through the flange 34 around the elastomeric member 40 and through the aligned holes 37 in first metallic member 30 and holes 44 in elastomeric member 40 such that the water level in the basement may be drained though the sealing valve 20.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A sealing valve for a floor drain in a house or commercial building, comprising a floor drain having a first internal dimension, said sealing valve comprising:

a) a first toad-stool shaped first metallic member having a cylindrical central base with an outwardly extending flange, said first member having a central aperture for receiving an actuating bolt, a first set of holes extending through said central base, and a second set of holes extending through said outwardly extending flange;

b) a second cylindrical elastomeric member having an external surface with a second external dimension less than a first internal dimension of the floor drain creating a peripheral flow path between the first internal dimension of the floor drain and said external surface of said second cylindrical elastomeric member, said second cylindrical elastomeric member having a central recess aligned with said central aperture in said first member and a plurality of holes aligned with said first set of holes extending through said central base creating auxiliary longitudinal flow paths;

c) a third member configured as a flat compression plate with a central threaded opening;

d) an actuating bolt extending through said first metallic member, said second elastomeric member and threadingly engaging in said centrally threaded opening of said third member;

whereby said actuating bolt compresses said second cylindrical elastomeric member and said second elastomeric member is compressed between a bottom surface of said cylindrical base and an upper surface of said flat compression plate causing lateral expansion thereof blocking off said peripheral flow path, said flat compression plate simultaneously blocking said auxiliary flow paths sealing a region above said sealing valve from a region below said sealing valve.

2. The sealing valve of claim 1 wherein said actuating bolt has an internal recess for receiving a operating tool allowing manual opening and closing of said sealing valve.

3. The sealing valve of claim 1 further comprising a cotter pin inserted through a hole in a distal end of said actuating bolt preventing said compression plate from inadvertently being removed from said actuating bolt.

* * * * *